US011275342B2

(12) United States Patent
Bifrare

(10) Patent No.: US 11,275,342 B2
(45) Date of Patent: Mar. 15, 2022

(54) REPEATER WITH DISENGAGEABLE TRANSMISSION MOBILE

(71) Applicant: Montres Breguet S.A., L'Abbaye (CH)

(72) Inventor: Christophe Bifrare, Le Pont (CH)

(73) Assignee: Montres Breguet SA., L'Abbaye (CH)

( * ) Notice: Subject to any disclaimer, the term of this patent is extended or adjusted under 35 U.S.C. 154(b) by 635 days.

(21) Appl. No.: 16/223,168

(22) Filed: Dec. 18, 2018

(65) Prior Publication Data

US 2019/0204785 A1 Jul. 4, 2019

(30) Foreign Application Priority Data

Jan. 4, 2018 (EP) ..... 18150369

(51) Int. Cl.

| | |
|---|---|
| ***G04B 21/12*** | (2006.01) |
| ***G04B 21/04*** | (2006.01) |
| ***G04B 11/00*** | (2006.01) |
| ***G04B 11/02*** | (2006.01) |

(52) U.S. Cl.

CPC ..... *G04B 21/12* (2013.01); *G04B 11/006* (2013.01); *G04B 11/02* (2013.01); *G04B 21/04* (2013.01)

(58) Field of Classification Search

CPC ..... G04B 21/12; G04B 21/04; G04B 21/00

See application file for complete search history.

(56) References Cited

FOREIGN PATENT DOCUMENTS

| | | |
|---|---|---|
| DE | 41 20 886 A1 | 1/1993 |
| EP | 0 451 339 A1 | 10/1991 |

OTHER PUBLICATIONS

European Search Report dated Jul. 18, 2018 in European Application 18150369.9, filed on Jan. 4, 2018 (with English Translation of Categories of Cited Documents).

Combined Chinese Office Action and Search Report dated Jul. 3, 2020 in corresponding Chinese Patent Application No. 201910001575.8 (with English Translation and English Translation of Category of Cited Documents), 10 pages.

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A repeater including an hours piece mounted to rotate between a rest position and a reading position; a device for regulating the angular speed of the hours piece, which includes a rotor and a system for braking the rotor; and a transmission gear train between the hours piece and the rotor, this gear train including a disengageable primary mobile able to adopt two configurations: a) an engaged configuration in which the primary mobile couples the hours piece to the rotor while the hours piece is moved from its reading position to its rest position; b) a disengaged configuration in which the primary mobile decouples the rotor from the hours piece as soon as the latter is stopped in the rest position.

20 Claims, 14 Drawing Sheets

REPEATER WITH DISENGAGEABLE TRANSMISSION MOBILE

CROSS-REFERENCE TO RELATED APPLICATION

This application claims priority to European Patent Application No. 18150369.9 filed on Jan. 4, 2018, the entire disclosure of which is hereby incorporated herein by reference.

TECHNICAL FIELD

The invention relates to the field of clockmaking. To be more precise, it concerns a repeater mechanism for a timepiece with a striking mechanism, the expression "timepiece" preferably designating a watch (a wristwatch or a pocket watch), but possibly also designating a clock.

TECHNOLOGICAL BACKGROUND

The function of the repeater mechanism (commonly referred to simply as a repeater) is, at the command of the user (or wearer) exerting pressure at any time on a button (or a bolt), to chime the hour indicated at that moment by the hands of the timepiece.

The repeater is a clockmaking complication of extreme refinement, mastery of which honors the clockmaker producing it. Previously intended to enable telling the time in darkness, the repeater nowadays equips watches of high, of even very high value.

A repeater conventionally comprises:

an hours snail;

an hours piece provided with a toothed sector and carrying an hours follower, the hours piece being mounted to rotate between a fixed rest position, in which the hours follower is angularly spaced from the hours snail, and a reading position in which the hours follower comes into contact with the hours snail.

In the absence of action on the part of the wearer, the hours piece is in its rest position.

The movement of the button (or of the bolt) causes forced rotation (generally by way of a return spring known as the hours spring) of the hours piece, initially immobilized in the rest position, to its reading position.

Releasing the button (or the bolt) is accompanied by the return to its rest position of the hours piece (it is generally returned by a barrel spring, which generates a return torque greater than the resisting torque opposed by the hours spring).

On moving, the hours piece meshes (directly or indirectly) with a hammer striking a gong a number of times equal to the number of hours read on the snail and proportional to the angular travel of the hours piece between its two positions (reading, rest).

The striking frequency of the hammer is proportional to the rotation speed of the hours piece. Consequently, if the hours piece is left free, when it is returned to its rest position it undergoes an acceleration that increases the striking frequency of the hammer. This phenomenon, known as runaway, renders the striking mechanism inaudible if the number of hours to be chimed increases.

It is therefore clear that, to chime the hours at fixed frequency, it is necessary to brake the hours piece to regulate its angular speed and therefore to prevent it running away.

This longstanding problem was first solved by means of an escapement regulator, notably described by C.-A. Reymondin et al in Théorie d'Horlogerie, Fédération des Ecoles Techniques, 2015, p. 222 and by F. Lecoultre in Les Montres Compliquées, published by Simonin, fifth edition, 2013, p. 74 and FIG. 22, plate 19.

However, as Lecoultre indicates, the escapement regulator has the disadvantage of being noisy, which Charles-Ami Barbezat-Baillot solved in 1889 by replacing it with a centrifugal force regulator comprising a pair of spring-loaded mobile levers. This regulator—which is after all a flywheel—is briefly described by Lecoultre (op.cit., p. 74 and FIG. 23 plate 19), and in detail by Barbezat-Baillot himself in his patent CH 334.

The manufacturer Breguet was thereafter to improve this regulator by associating with it a magnetic brake, which made it possible to miniaturize it (European patent EP 2487547).

However, the regulator, whether of the escapement, centrifugal force or magnetic type, can exercise its function correctly only on condition that is turns at very high speed (of the order of 1000 to 2000 rpm). This speed is achieved by means of a transmission gear train, which meshes on the one hand with the hours piece and on the other hand with the regulator. This causes a technical problem because, arriving at its rest position, the hours piece stops dead. It then stops the regulator, via the transmission gear train. It is easily understandable that the regulator then suffers a high deceleration. Repeated decelerations induce in the components of the regulator a mechanical fatigue compromising their longevity. It may further be noted that the sudden stopping of the regulator conversely produces a kickback that is transmitted to the hours piece via the transmission gear train, which amplifies it. This kickback phenomenon (also known as hammer) is reflected in impacts on the toothed sector of the hours piece. These repeated impacts induce in the toothed sector mechanical fatigue comprising its longevity.

A first objective of the invention is, in a repeater, to minimize the mechanical fatigue of its mobile components.

A second objective is, more precisely, to prevent the sudden decelerations of the regulator and the hammer generated in the hours piece by it stopping dead at its end of travel.

SUMMARY OF THE INVENTION

There is proposed, firstly, a repeater mechanism for a timepiece with a striking mechanism, which comprises:

an hours snail;

an hours piece provided with a toothed sector and carrying an hours follower, the hours piece being mounted to rotate between a fixed rest position, in which the hours follower is angularly spaced from the hours snail, and a reading position in which the hours follower comes into contact with the hours snail;

a device for regulating the angular speed of the hours piece, which comprises a rotor and a system for braking the rotor;

a transmission gear train between the hours piece and the rotor and which comprises a disengageable primary mobile able to adopt two configurations:

an engaged configuration in which the primary mobile couples the hours piece and the rotor while the hours piece is moved from its reading position to its rest position; and a disengaged configuration in which the primary mobile decouples the rotor and the hours piece as soon as the latter is stopped in the rest position.

Accordingly, when the hours piece is moved from its reading position to its rest position, it drives, via the transmission gear train the primary mobile of which is in the engaged configuration, the rotor which regulates its angular speed and enables chiming of the current hour at fixed frequency. On the other hand, as soon as the hours piece is stopped in the rest position, the primary mobile, in the disengaged configuration, allows the rotor to continue its freewheeling rotation, which eliminates the impacts caused by stopping the hours piece.

According to one particular embodiment, the primary mobile comprises:

- a primary input wheel, mounted to rotate about a primary axis and connected to the hours piece;
- a primary output wheel rotatable relative to the primary input wheel and connected to the rotor; and
- a unidirectional primary epicyclic gear train disposed between the primary input wheel and the primary output wheel.

The primary epicyclic gear train comprises for example a primary sun gear constrained to rotate with the primary output wheel, and one or more primary planet gears mounted on the primary input wheel and meshing with the primary sun wheel.

The primary sun wheel advantageously has symmetrical teeth, and the or each primary planet gear has asymmetrical teeth. There are for example three primary planet gears.

The transmission gear chain may further comprise a secondary mobile between the primary mobile and the hours piece, this secondary mobile comprising a secondary input gear mounted to rotate about a secondary axis and that meshes with the toothed sector of the hours piece, and a secondary output wheel connected to the primary mobile.

The secondary mobile is preferably disengageable. In this case, the secondary output wheel is for example rotatable relative to the secondary input gear, and the secondary mobile comprises a unidirectional secondary epicyclic gear train between the secondary input gear and the secondary output wheel.

The secondary epicyclic gear train comprises for example a secondary sun gear constrained to rotate with the secondary input gear, and one or more secondary planet gears mounted to rotate on the secondary output wheel and meshing with the secondary sun wheel.

The secondary sun wheel advantageously has symmetrical teeth, and the (or each) secondary planet gear has asymmetrical teeth. There are for example three secondary planet gears.

According to one embodiment, the transmission gear train further comprises a middle mobile between the primary mobile and the secondary mobile. The middle mobile comprises for example a middle gear mounted to rotate about a middle axis, and a middle wheel constrained to rotate with the middle gear and meshing with the primary mobile.

The primary mobile advantageously comprises a primary gear, fastened to the primary input wheel and meshing with the middle wheel.

There is proposed, secondly, a timepiece, such as a watch, equipped with a repeater mechanism as described above.

BRIEF DESCRIPTION OF THE FIGURES

Other objects and advantages of the invention will become apparent in the light of the description of one embodiment given hereinafter with reference to the appended drawings, in which.

DETAILED DESCRIPTION OF THE INVENTION

Figure 1:
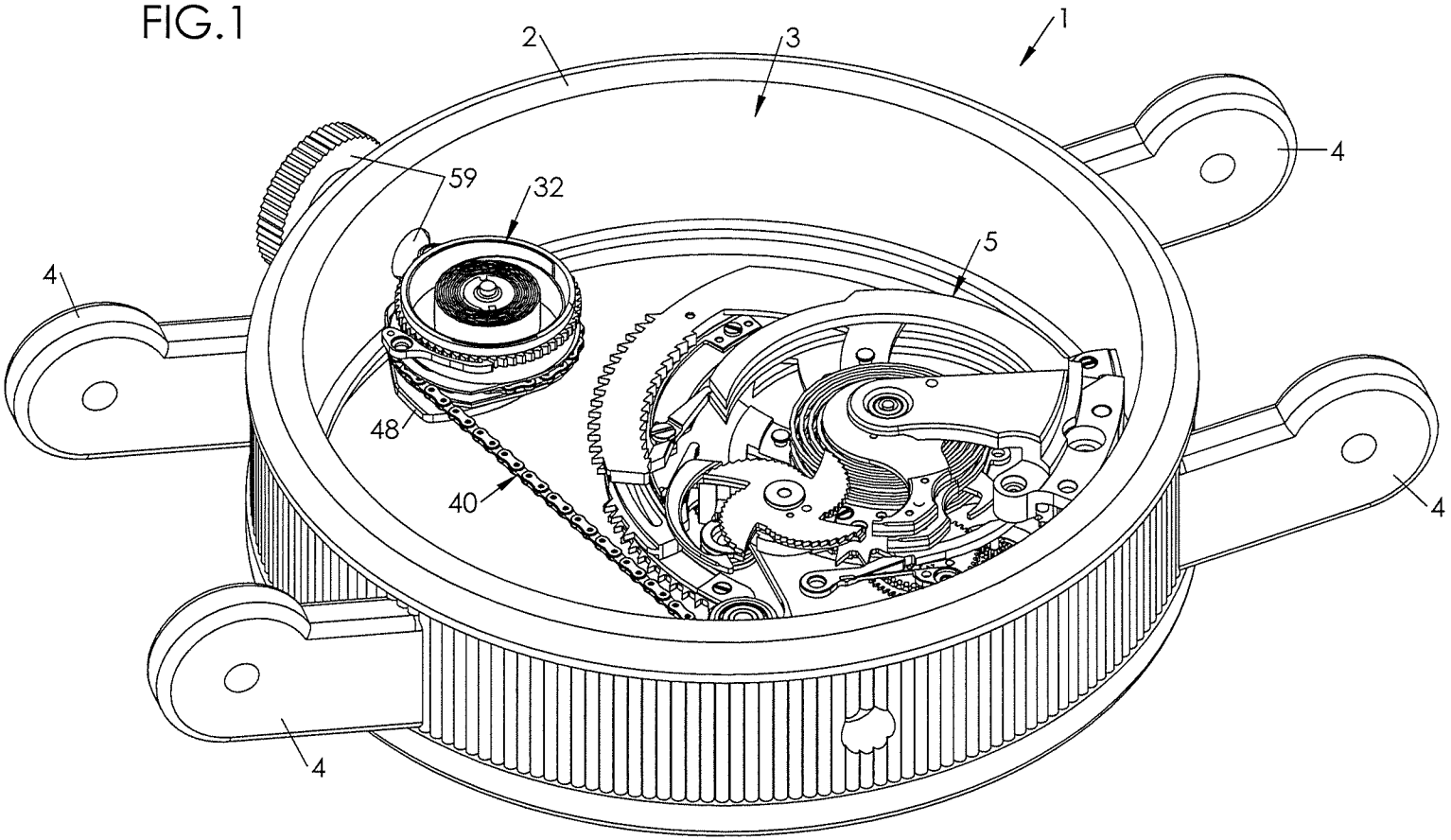
FIG. 1 is a perspective partial view showing a watch equipped with a repeater mechanism.

In FIG. 1 is partially represented a timepiece, in this instance a watch 1. The watch 1 comprises a middle 2 that defines an internal volume 3. In the example illustrated, the watch is designed to be worn on the wrist, and to this end its middle comprises projecting lugs 4, on which it is intended a wristwatch strap (not represented) will be fixed.

The watch 1 comprises a clock movement designed to indicate at least hours and minutes. The movement comprises a plate intended to come to be housed in the internal volume 3 defined by the middle 2, being fixed thereto.

The movement further comprises various functional components grouped into subassemblies. When a subassembly has a function other than displaying hours, minutes and, where appropriate, seconds, it is termed a "complication".

Accordingly, the timepiece (that is to say the watch 1) illustrated has a striking mechanism and, for the purpose of chiming the current hour, comprises a repeater mechanism, also termed a "repeater complication" or, more simply (and as employed hereinafter), a "repeater" 5.

The repeater 5 comprises, firstly, at least one hours snail 6. This snail 6 is mounted to rotate about an axis A1. It has a spiral general shape and comprises on its periphery a succession of twelve angular sectors at decreasing distances from the axis A1. The hours snail 6 is constrained to rotate with an hours star 7 that comprises twelve pointed teeth.

In the example illustrated, the repeater 5 also comprises a quarter-hours snail 8, mounted to rotate about an axis A2. The quarter-hours snail 8 comprises four angular sectors at decreasing distances from the axis A2, separated by smooth junction faces.

The repeater 5 further comprises a minutes snail 9, constrained to rotate with the quarter-hours snail 8 and that comprises four branches notched at their perimeter, separated by smooth junction faces that extend in line with the junction faces of the quarter-hours snail 8.

The quarter-hours snail 8 carries in the vicinity of its periphery a finger which, on each rotation, comes to mesh with a tooth of the hours star 7 to cause the latter to turn by one twelfth of a revolution representing an advance of one hour.

The repeater 5 comprises, secondly, an hours piece 10, mounted to rotate about an axis A3 and carrying an hours follower 11.

The hours piece 10 is mounted to rotate about its axis A3 between a rest position, in which the hours follower 11 is angularly spaced from the hours snail 6, and a reading position, in which the hours follower 11 comes into contact with the hours snail 6.

Figure 3:
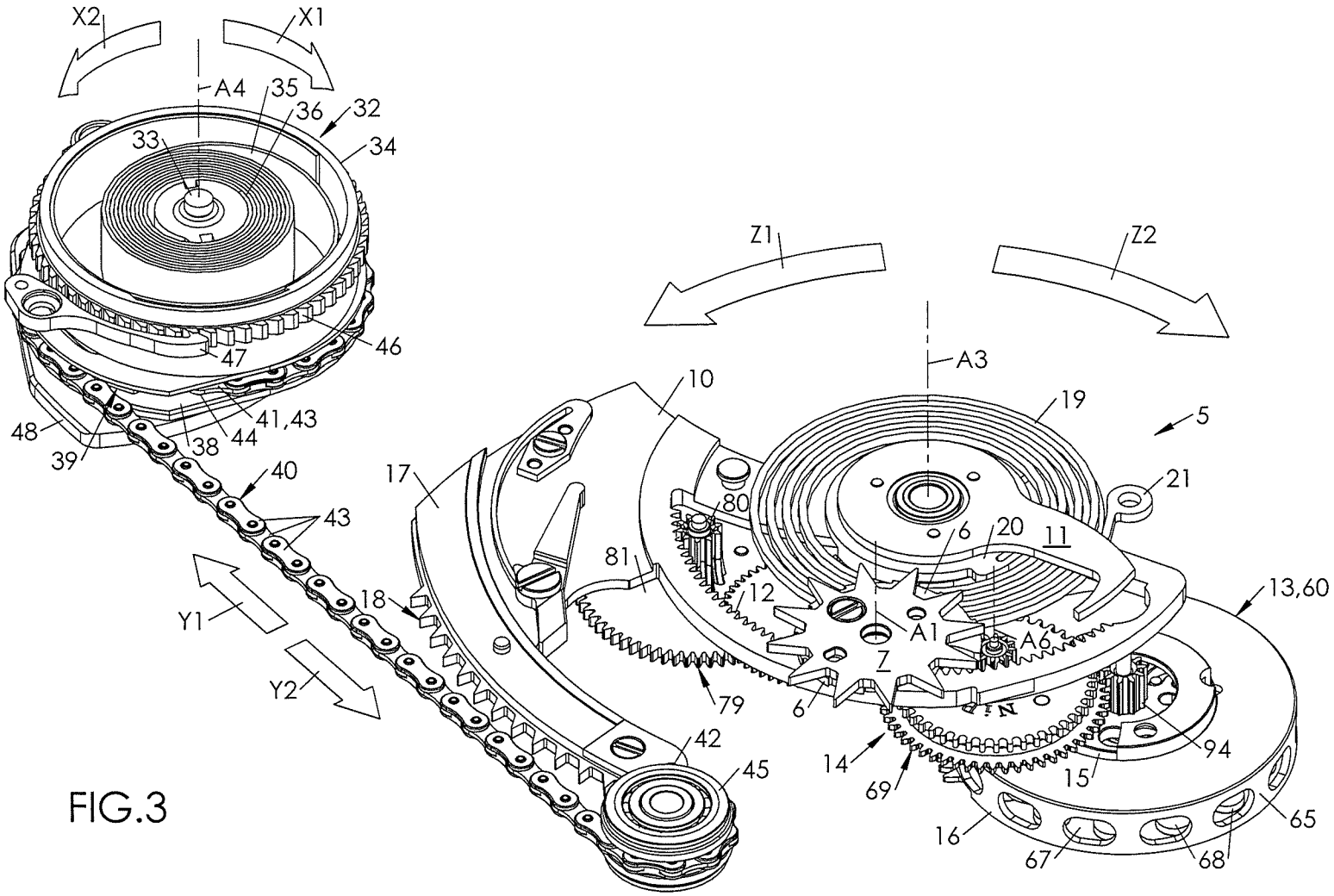
FIG. 3 is a perspective view of the repeater mechanism, partly stripped to show its operation more clearly.

As illustrated in FIG. 3, the hours piece 10 comprises a toothed sector 12 coupled to a regulation device (or regulator) 13 via a transmission gear train 14. In the example illustrated, the regulator 13 comprises a rotor 15 mounted to rotate in a stator 16. The regulator 13 will be described in more detail hereinafter.

The hours piece 10 comprises an exterior arm 17 provided with an hours rack 18 consisting of twelve projecting teeth. When the hours piece returns from its reading position to its rest position, the hours rack 18 actuates an hours hammer (not represented) which comes to strike an hours gong tuned to a predetermined acoustic frequency, possibly amplified by a structural part of the watch 1 (for example the middle 2). The hours hammer strikes the hours gong a number of times (between one and twelve inclusive) equal to the number of teeth of the rack 18 that actuated it during the return of the hours piece 10 from its reading position to its rest position.

The repeater 5 comprises, fourthly, an hours spring 19, which returns the hours piece 10 to its rest position. In the example illustrated, the hours spring 19 is a spiral spring. It is advantageously fixed to the hours piece by an internal end 20, and to a shaft fastened to the plate by an external end 21.

Figure 2:
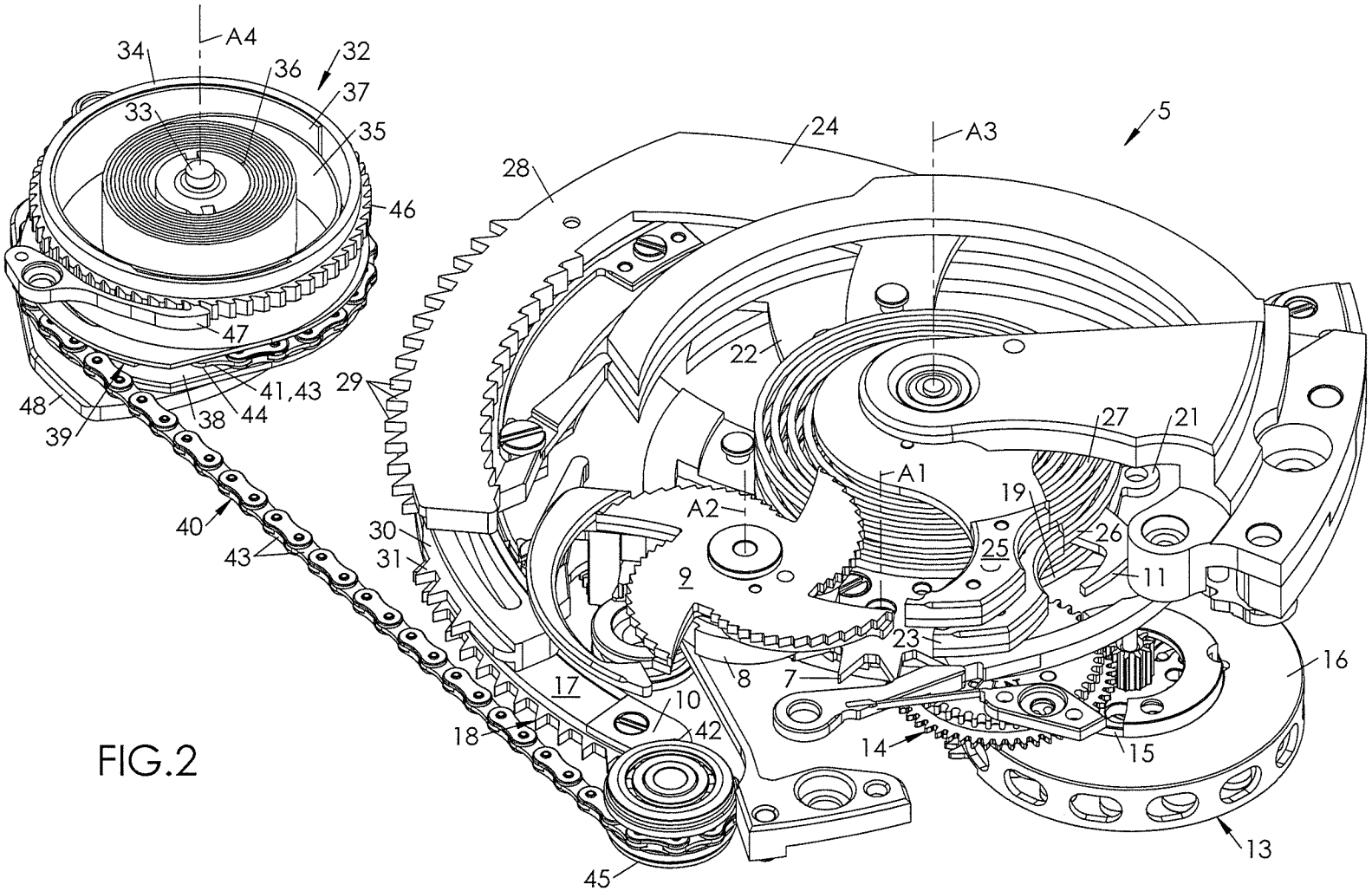
FIG. 2 is a perspective view of the repeater mechanism alone, to a larger scale.

In the example illustrated in FIG. 2, the repeater 5 comprises a quarter-hours piece 22 carrying a quarter-hours follower 23 and mounted to rotate about the axis A3 between a rest position, in which the quarter-hours follower is angularly spaced from the quarter-hours snail 8, and a reading position in which the quarter-hours follower comes into contact with the quarter-hours snail 8.

In the example illustrated in FIG. 2, the repeater further comprises a, minutes piece 24 carrying a minutes follower 25 and mounted to rotate about the axis A3 between a rest position, in which the minutes follower 25 is angularly spaced from the minutes snail 9, and a reading position, in which the minutes follower comes into contact with the minutes snail.

The repeater 5 also comprises a quarter-hours spring 26 that returns the quarter-hours piece 22 to its rest position, and a minutes spring 27 that returns the minutes piece 24 to its rest position.

The minutes piece 24 is provided, on an exterior arm 28, with a minutes rack 29 consisting of fourteen projecting teeth. When the minutes piece 24 is returned from its reading position to its rest position, the minutes rack actuates a minutes hammer (not represented) that comes to strike a minutes gong tuned to a predetermined frequency different from (for example lower than) the acoustic frequency of the hours gong. The minutes hammer strikes the minutes gong a number of times (between zero and fourteen inclusive) equal to the number of teeth of the minutes rack that actuated it during the return of the minutes piece from its reading position to its rest position.

The quarter-hours piece 22 is provided, on an exterior arm 30, with a quarter-hours rack 31 consisting of three series of projecting teeth. When the quarter-hours piece is returned from its reading position to its rest position, the quarter-hours rack actuates the hours hammer and the minutes hammer almost simultaneously to generate a closely spaced sequence of two notes. The hours hammer and the minutes hammer strike their respective gongs a number of times (between zero and three inclusive) equal to the number of series of teeth of the quarter-hours rack that actuated them when the quarter-hours piece 22 is returned from its reading position to its rest position.

As is seen in FIG. 2, the hours piece 10, the quarter-hours piece 22 and the minutes piece 24, mounted to rotate about the same axis A3, are angularly offset relative to one another, in such a manner that, during their rotation together about the axis A3, the readings occur successively in the following order: minutes; quarter-hours; hours. Striking is effected in the opposite order, however: hours; quarter-hours; minutes.

The repeater 5 comprises, fifthly, a striking mechanism barrel 32. This striking mechanism barrel is mounted to rotate about a barrel axis A4. The striking mechanism barrel is a subassembly that comprises a plurality of components, including:

- a barrel shaft 33;
- a barrel drum 34;
- a barrel spring 35 an internal end 36 of which is fastened to the barrel shaft 33 and an external end 37 of which is fastened to the barrel drum 34; and
- a pulley 38.

The barrel shaft 33, the barrel drum 34 and the pulley 38 are all three mounted to rotate about the barrel axis A4. According to a preferred embodiment, the pulley defines a peripheral cam path 39.

The repeater 5 comprises, sixthly, a chain 40 adapted to be wound partially onto the pulley 38. To be more precise, the chain 40 is adapted to be wound partially onto the cam path 29. This chain is attached, by a proximal end 41, to the pulley 38 and, by a distal end 42, to the hours piece 10.

The chain 40 comprises a plurality of links 43 articulated to one another. The link situated at the proximal end 41 of the chain 40 is attached to a pin 44 fastened to the pulley 38. The link situated at the distal end 42 of the chain 40 is for its part attached to a pin (not visible) fastened to the exterior arm 17 of the hours piece 10.

According to an embodiment illustrated in FIG. 2 and FIG. 3, the repeater 5 comprises an idler bearing 45 on which the chain 40 travels, between the striking mechanism barrel 32 and the hours piece 10. This idler bearing 45 advantageously takes the form of a rolling bearing (for example a ball bearing).

As illustrated in FIG. 2 and FIG. 3, the barrel drum 34 carries, on its periphery, a toothed ring 46 with asymmetrical teeth, and the repeater 5 comprises an immobilizing pawl 47 interengaged with this toothed ring 46, to prevent rotation of the barrel drum in the direction of unwinding the chain 40.

Figure 4:
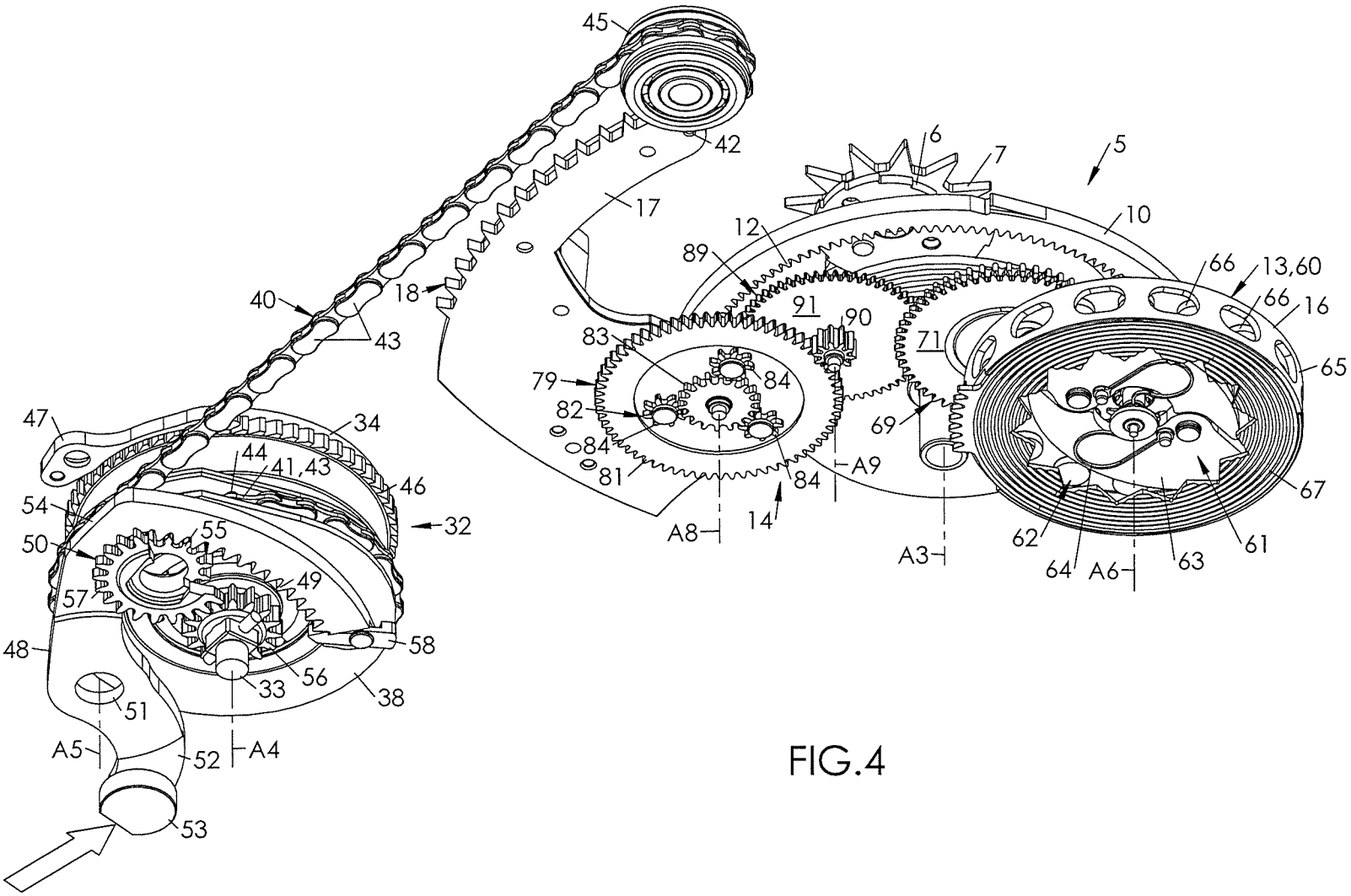
FIG. 4 is a perspective view of the mechanism from FIG. 3, as seen from another angle.

As represented in FIG. 4, the repeater 5 comprises, seventhly:

- a rack 48 mounted to rotate about a fixed rack axis A5, and provided with a toothed sector 49; and
- a striking mechanism gear train 50 meshing on one hand with the rack 48 and on the other hand with the barrel shaft 33.

The rack 48 is hook-shaped. This rack is provided with a bore 51 by means of which it is mounted on its axis A5. On either side of this bore, the rack comprises a lever 52 carrying at its end a button 53 (which, in the example illustrated, is mounted in and chased into a hole formed in the end of the lever), and a cranked arm 54 in which the toothed sector 49 is formed. The rack is mounted to rotate about its axis A5 between a rest position (FIG. 4) and a complete arming position.

According to an embodiment illustrated in FIG. 4, the striking mechanism gear train 50 comprises an input gear 55 meshing with the rack 48, and an output gear 56 constrained to rotate with the barrel shaft 33.

In the example illustrated, the striking mechanism gear train 50 further comprises a multiplier gear 57 (partially cut away in FIG. 4) constrained to rotate with the input gear 55 and meshing with the output gear 56.

As also seen in FIG. 4, the rack 48 is advantageously provided, at the free end of the toothed sector 49, with a stop abutment 58, that here takes the form of a mounted and chased part, and that, in the complete arming position of the rack, comes to be locked against the input gear 55 which therefore forms an end of travel abutment for it.

As illustrated in FIG. 1, the watch 1 is equipped with a crown wheel 59. This crown wheel 59 is mounted to move in translation relative to the middle 2 between a disarmed position, in which the crown wheel does not exert any drive torque on the rack 48, and an arming position in which the crown wheel exerts on the rack a thrust (indicated by the white arrow bottom left in FIG. 4) generating a drive torque that drives the barrel shaft 33 in rotation via the striking mechanism gear train 50.

The repeater 5 is actuated by pressing the crown wheel 59 with the finger. The crown wheel pushes the button 53, which via the lever 52 causes the rack 48 to pivot about its axis A5. By the meshing of its toothed sector 49, the rack drives the input gear 55 in rotation, which rotation the multiplier gear 57, fastened to the latter, transmits to the output gear 56, which drives in rotation the barrel shaft 33 (in the direction of the arrow X2 in FIG. 3) and the pulley 38 that is fastened to it. The forced rotation of the rack 48 and of the parts that it drives is countered by the return torque imposed by the barrel spring 35, the internal end 36 of which turns with the barrel shaft 33 while the external end 37 remains fixed to the barrel drum 34 immobilized by the pawl 47 interengaged with the toothed ring 46. It is consequently clear that the effect of the rotation of the rack 48 is to arm the barrel spring.

The chain 40, pulled (in the direction of the arrow Y2 in FIG. 3) from the side of its distal end 42 by the hours piece 10, itself returned in rotation (in the direction of the arrow Z2 in FIG. 3) to its reading position by the hours spring 19, is unwound from the pulley 38.

Arrived at the reading position, in which the hours follower 11 comes into contact with the hours snail 6, the hours piece 10 is stopped, whereas, where applicable, the quarter-hours piece 22 and the minutes piece 24 are able to continue their rotation, respectively returned to their reading positions by the quarter-hours spring 26 and the minutes spring 27, until the quarter-hours follower 23 and the minutes follower 25 come into contact, respectively, with the quarter-hours snail 8 and the minutes snail 9.

Releasing the pusher member 59 releases the barrel spring 35, the external end 37 of which remains fixed to the barrel drum 34 and the internal end 36 of which drives rotation of the barrel shaft 33 (in the direction indicated by the arrow X1 in FIG. 1) and with it the pulley 38 (in the same rotation direction). As the return torque imposed on the pulley by the barrel spring is greater than (or even very much greater than) the resisting torque in the opposite direction applied to the hours piece 10 by the hours spring 19, the pulley 38 pulls the chain 40, which is wound onto it (in the direction indicated in FIG. 3 by the arrow Y1), entraining with it the hours piece rotating about its axis A3, in the direction indicated in FIG. 3 by the arrow Z1, until the hours piece reaches its rest position, in which it comes to abut against the idler bearing 45, which immobilizes the repeater 5.

During the travel accompanying the release of the pusher member 59, the hours piece 10, the quarter-hours piece 22 and the minutes piece 24 have, together (and in the manner explained above) chimed the displayed hour.

It is so that chiming is effected at a predetermined fixed frequency that the repeater 5 is provided with the device 13 for regulating the angular speed of the hours piece 10, referred to simply hereinafter as the "regulator".

The regulator 13 comprises, as we have seen, a rotor 15, here in the form of a perforated disk, mounted to rotate about an axis A6, and a system 60 for braking the rotor 15.

Figures 5A, 5B:
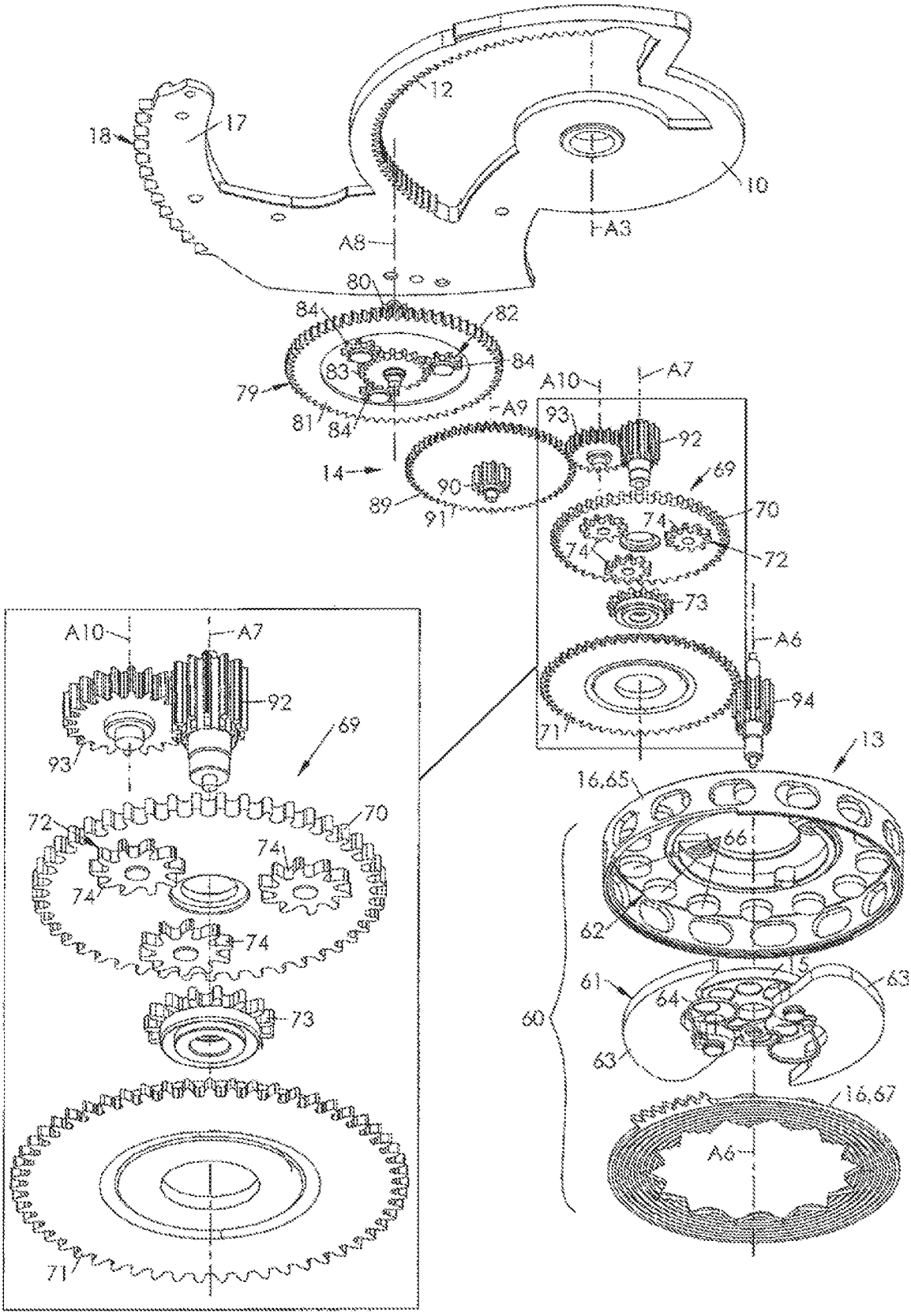
FIG. 5A is a exploded perspective view showing the hours piece, the regulation device and the transmission gear train
FIG. 5B is, in the bottom left detail insert, a close up of the disengageable primary mobile.
Figure 6:
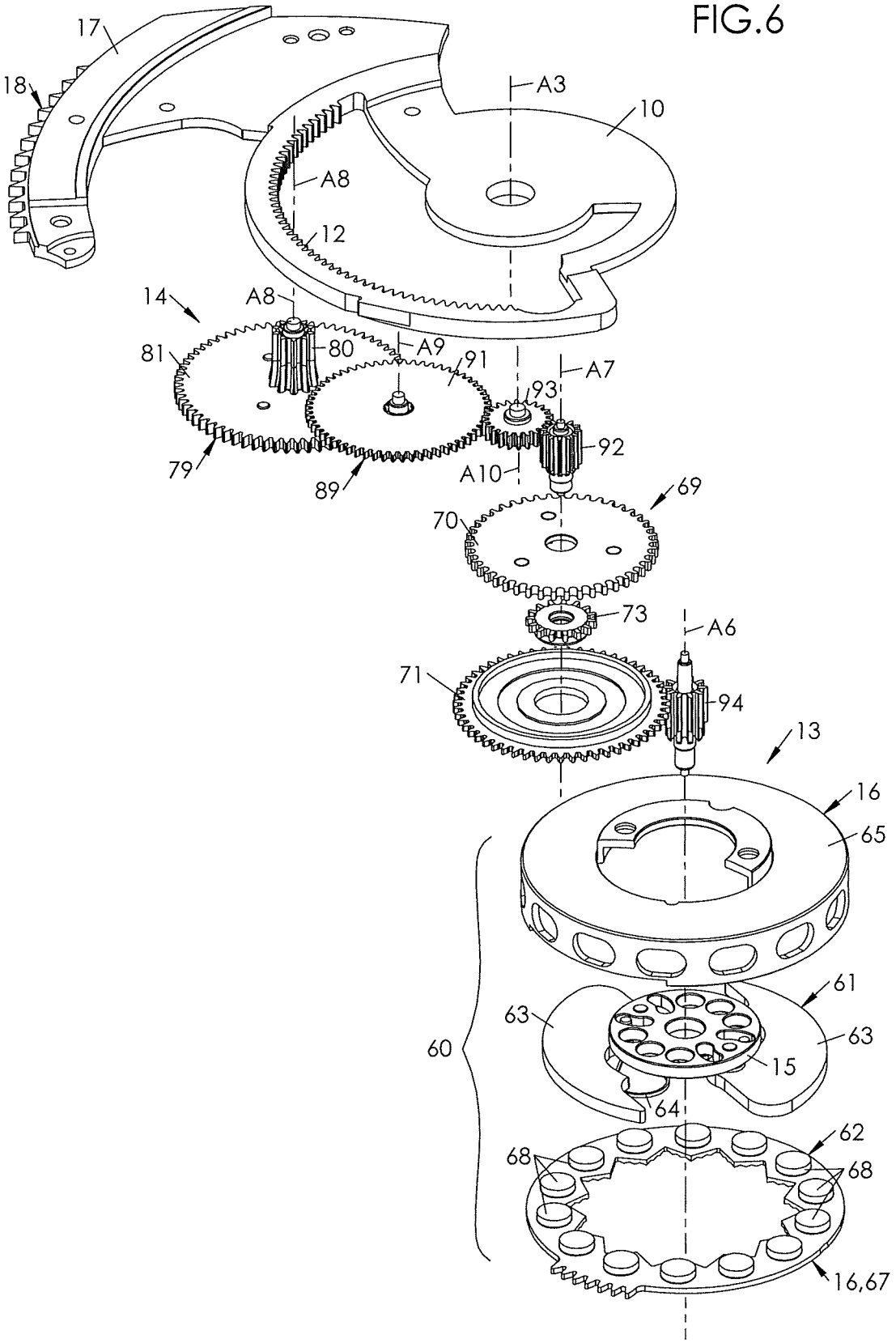
FIG. 6 is an exploded perspective view showing the components from FIG. 5A seen from another angle.
Figure 7:
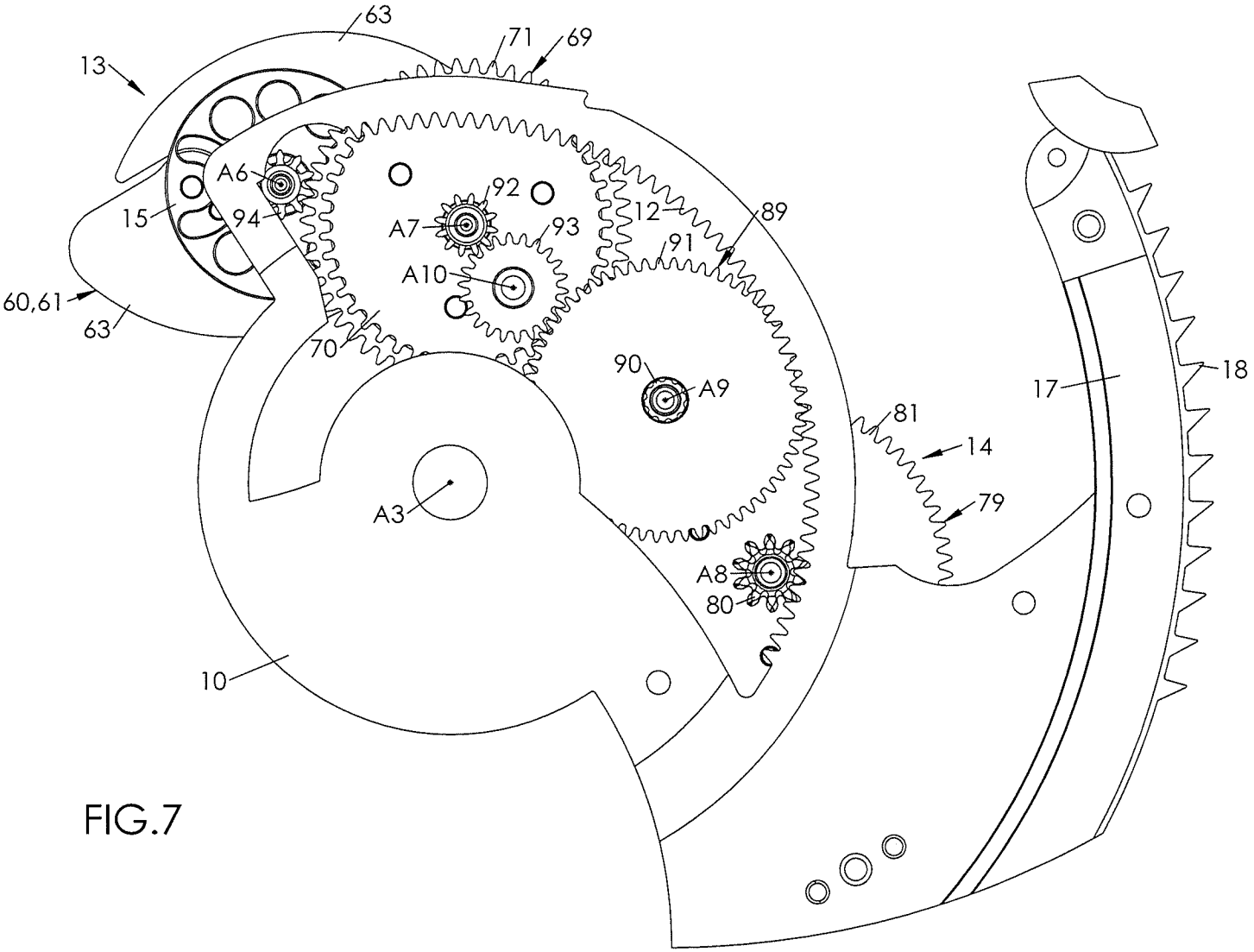
FIG. 7 is a bottom view showing the hours piece, the transmission gear train and the rotor in the rest position of the hours piece, before actuation thereof.

According to an embodiment illustrated by FIG. 5A, FIG. 5B, and FIG. 6, the braking system 60 is a combined system. To be more precise, the braking system 60 is of the magneto-inertial type, that is to say it comprises an inertial sub-system 61 and a magnetic subsystem 62.

In this embodiment, the inertial subsystem 61 comprises a pair of weights 63 mounted on the rotor 15 and articulated between a contracted configuration (adopted when the angular speed of the rotor 15 is zero, FIG. 7 to FIG. 10), in which the weights are close to one another and oppose to the rotation of the rotor 15 a relatively low inertia, and a deployed configuration (adopted when the angular speed of the rotor 15 is non-zero) in which, because of centrifugal force, the weights 63 are moved away from one another and oppose to the rotation of the rotor 15 a higher inertia and thereby contribute to braking it (FIG. 11 to FIG. 14). One (or more) spring(s) 64 attached to the weights return them to their contracted position.

The magnetic subsystem 62 comprises the stator 16, which generates an alternating stationary magnetic field around the rotor 15 and the weights 63.

To be more precise, the stator 16 is provided with a cage 65 carrying, at its periphery, a first series of permanent magnets 66 with alternating polarities and, fixed to the cage 65, a flange 67 carrying, at its periphery, a second series of permanent magnets 68 with alternating polarities disposed facing the magnets of the first series, so as to form magnetic field lines that extend in a loop from each facing pair of magnets 66, 68 to each adjacent pair.

The weights 63 are made from a ferromagnetic material. When the weights are driven in rotation in the alternating stationary magnetic field, the latter generates Eddy currents in the weights that induce a counter-electromotive Laplace force that brakes their rotation (and therefore that of the rotor 15).

The rotor 15 is driven in rotation by the hours piece 10 over a part of its travel from its reading position to its rest position.

To provide this driving, the repeater 5 is further provided with a transmission gear train 14, inserted between the hours piece 10 and the rotor 15. The gear train 14 provides transmission with demultiplication the ratio of which will be referred to hereinafter.

The transmission gear train comprises a disengageable primary mobile 69 able to adopt two configurations:

a) an engaged configuration in which the primary mobile 69 couples the hours piece 10 and the rotor 15 while the hours piece 10 is moved from its reading position to its rest position;

b) a disengaged configuration in which the primary mobile 69 decouples the rotor 15 and the hours piece 10 as soon as the latter is stopped in the rest position.

According to an embodiment illustrated in the figures, and more particularly in FIG. 5A and FIG. 5B, the primary mobile 69 comprises:

- a primary input wheel 70, mounted to rotate about a primary axis A7 and connected to the hours piece 10;
- a primary output wheel 71 rotatable relative to the primary input wheel 70 and connected to the rotor 15; and
- a unidirectional primary epicyclic gear train 72, disposed between the primary input wheel 70 and the primary output wheel 71.

In the example illustrated, the primary epicyclic gear train 72 comprises a primary sun wheel 73, constrained to rotate with the primary output wheel 71, and one (or more: three in the example illustrated) primary planet gear(s) 74 mounted on the primary input wheel 70 and meshing with the primary sun wheel 73.

According to a preferred embodiment, the primary sun wheel 73 has symmetrical teeth 75, and the (or each) primary planet gear 74 has asymmetrical teeth 76.

To be more precise, and as illustrated in the detail circles at the top in FIG. 8, FIG. 10, FIG. 12 and FIG. 14, each tooth of the teeth 76 of the primary planet gear 74 has a curved anterior flank 77, and a straight posterior flank 78.

In FIG. 8, FIG. 10, FIG. 12 and FIG. 14, the primary output wheel 71 is partially cut away at its centre to expose the primary epicyclic gear train 72.

When the primary input wheel 70 is driven in rotation relative to the primary output wheel 71 (constrained to rotate with the primary sun wheel 73) so that the teeth 76 of each primary planet gear 74 impinge on the teeth 75 of the primary sun wheel on the side of the posterior flanks 78 (detail circle at the top in FIG. 12), the teeth 76 (and therefore the primary planet gear) come to be braced against the teeth of the primary sun wheel, which constrains the primary input wheel 70 and the primary sun wheel 73 (and therefore the primary output wheel 71) to rotate together: this is the engaged configuration of the primary mobile 69.

A contrario, when the primary output wheel 71 (constrained to rotate with the primary sun wheel 73) is driven in rotation relative to the primary input wheel 70 so that the teeth 75 of the primary sun wheel drive the teeth 76 of each primary planet gear 74 on the side of the anterior flank 77 (detail inset at the top in FIG. 14), the teeth 75 slide on the anterior edges 77 of the teeth 76 and the primary sun wheel drives the primary planet gear in rotation about its own axis, without driving the primary input wheel: this is the disengaged configuration of the primary mobile 69.

According to an embodiment illustrated in the drawings, and more particularly in FIG. 5A, FIG. 5B, FIG. 8, FIG. 10, FIG. 12 and FIG. 14, the transmission gear train 14 comprises a secondary mobile 79 between the primary mobile 69 and the hours piece 10.

The secondary mobile 79 comprises a secondary input gear 80, mounted to rotate about a secondary axis A8 and meshing with the toothed sector 12 of the hours piece 10, and a secondary output wheel 81 connected to the primary mobile 69. According to a preferred embodiment, the secondary mobile 79 is disengageable.

To this end, in the example illustrated, the secondary output wheel 81 is rotatable relative to the secondary input gear 80, and the secondary mobile 79 comprises a unidirectional secondary epicyclic gear train 82, between the secondary input gear and the secondary output wheel.

Still in the example illustrated, the secondary epicyclic gear train 82 comprises a secondary sun wheel 83, constrained to rotate with the secondary input gear 80, and one (or more: three in the example illustrated) secondary planet gear(s) 84 mounted to rotate on the secondary output wheel 81 and meshing with the secondary sun wheel.

According to a preferred embodiment, the secondary sun wheel 83 has symmetrical teeth 85, and the (or each) secondary planet gear 84 has asymmetrical teeth 86. To be more precise, and as illustrated in the detail circles bottom left in FIG. 8, FIG. 10, FIG. 12 and FIG. 14, each tooth of the teeth 86 of the secondary planet gear has a curved anterior flank 87 and a straight posterior flank 88.

When the secondary input gear 80 (with the secondary sun wheel 83 that is fastened to it) is driven in rotation relative to the secondary output wheel 81 so that the teeth 85 of the secondary sun wheel drive the teeth 86 of each secondary planet gear 84 on the side of the posterior flanks 88 (detail inset at the bottom in FIG. 12), the teeth 86 (and therefore the secondary planet gear 84) is braced against the teeth 85 of the secondary sun wheel, which constrains the latter and the secondary output wheel to rotate together: the secondary mobile 79 then adopts an engaged configuration.

A contrario, when the secondary output wheel 81 is driven in rotation relative to the secondary input gear 80, so that the teeth 86 of each secondary planet gear drive the teeth 85 of the secondary sun wheel on the side of the anterior flanks 87 (detail inset on the left in FIG. 14), the teeth of each secondary planet gear 84 slide on the anterior flanks of the teeth of the secondary sun wheel, the secondary planet gear then freewheeling relative to the secondary sun wheel 83. The secondary output wheel 81 then turns without driving the secondary sun wheel 83 (or the secondary input gear 80 that is fastened to the latter): the secondary mobile 79 then adopts a disengaged configuration.

Moreover, according to a preferred embodiment that can be see in the drawings from FIG. 4 onwards, the transmission gear train 14 also comprises a middle mobile 89, between the primary mobile 69 and the secondary mobile 79.

In the example illustrated, the middle mobile 89 comprises a middle gear 90 mounted to rotate about a middle axis A9, and a middle wheel 91 constrained to rotate with the middle gear 90 and meshing with the primary input wheel 70 of the primary mobile 69.

Still in the example illustrated, the middle wheel 91 does not mesh directly with the primary input wheel 70. In fact, the primary mobile 69 comprises a primary gear 92 constrained to rotate with the primary input wheel. It is this primary gear 92 that meshes with the middle wheel 91, possibly (as shown) with between them a reversing gear 93 mounted to rotate about a reversing axis A10.

Likewise, in the example illustrated, the primary output wheel 71 and the rotor 15 are connected by a rotor gear 94, constrained to rotate with the rotor and meshing with the primary output wheel.

Accordingly, to recapitulate, the kinematic system that connects the hours piece 10 to the rotor 15 comprises in succession:

- the secondary input gear 80, which meshes with the toothed sector 12 of the hours piece 10;
- the secondary output wheel 81, connected to the secondary input gear by the secondary epicyclic gear train 82 and which is either constrained to rotate with it (in the engaged configuration of the secondary mobile 79), or decoupled from it (in the disengaged configuration of the secondary mobile);
- the middle gear 90, meshing with the secondary output wheel 81;
- the middle wheel 91, constrained to rotate with the middle gear 90;

the reversing gear 93, meshing with the middle wheel 91;

the primary gear 92, meshing with the reversing gear 93;

the primary input wheel 70, constrained to rotate with the primary gear 92;

the primary output wheel 71, connected to the primary input wheel 70 by the primary epicyclic gear train 72 and which is constrained to rotate with it (in the engaged configuration of the primary mobile 69) or decoupled from it (in the disengaged configuration of the primary mobile); and the rotor gear 94, which meshes with the primary output wheel and is constrained to rotate with the rotor 15.

Figure 8:
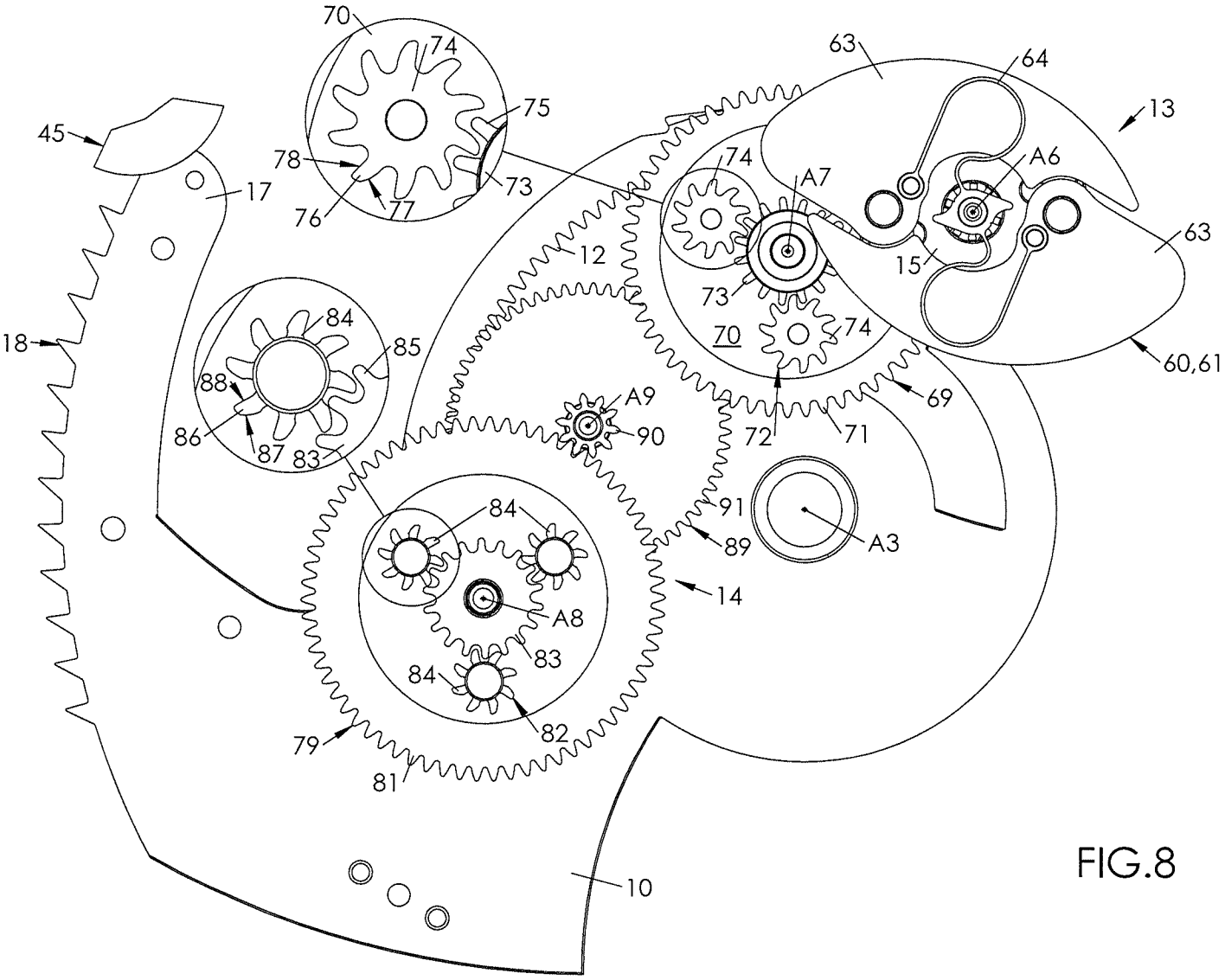
FIG. 8 is a top view of the components from FIG. 7.

We have already explained the actuation of the repeater 5. Previously, the hours piece 10 is immobile, locked against the idler bearing 45. Similarly, the rotor 15 is immobile, and the same applies to the components of the transmission gear train 14 (FIG. 7; FIG. 8).

Figure 9:
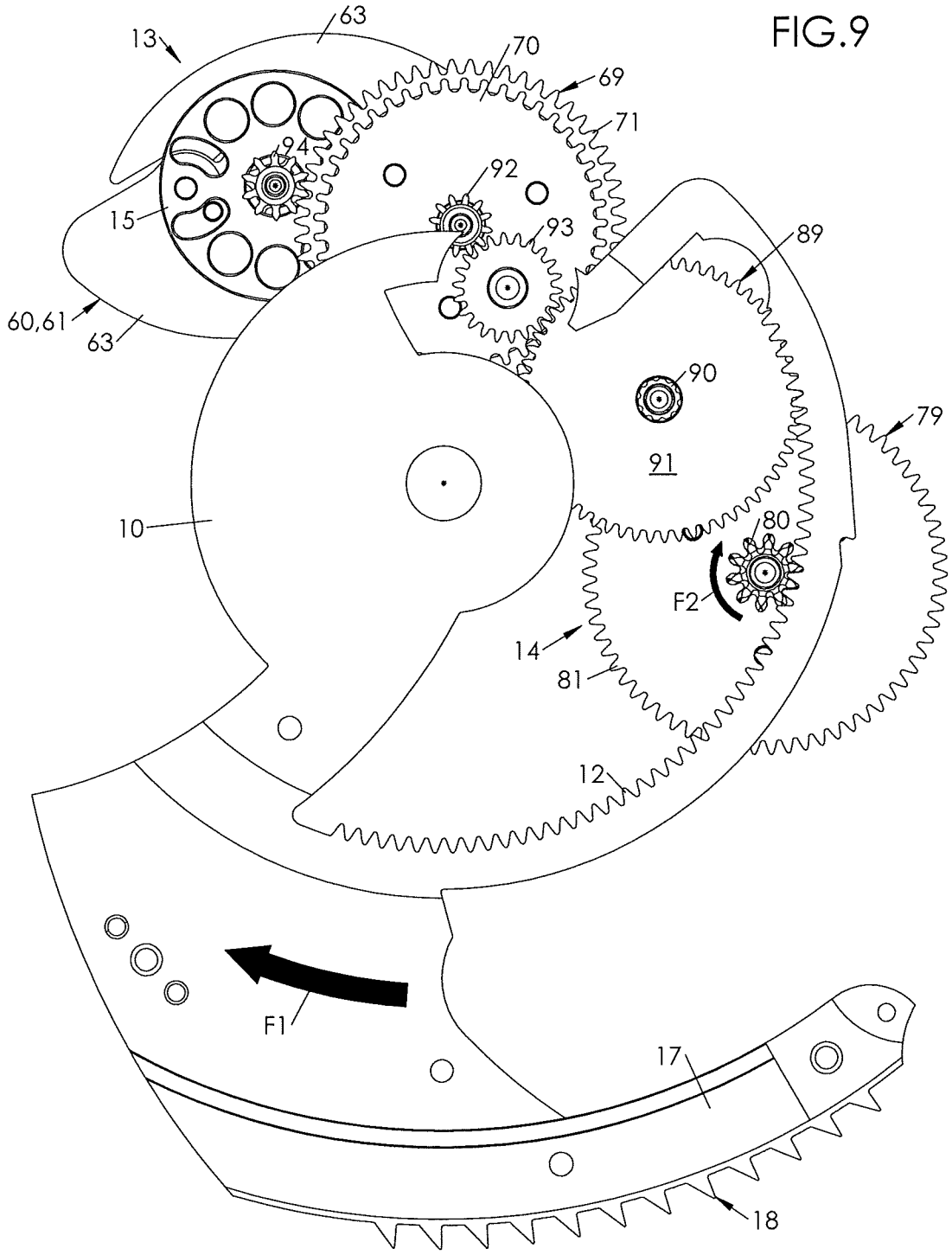
FIG. 9 and FIG. 10 are views similar to FIG. 7 and FIG. 8, respectively, illustrating the actuation of the hours piece, which is moved to its reading position.
Figure 10:
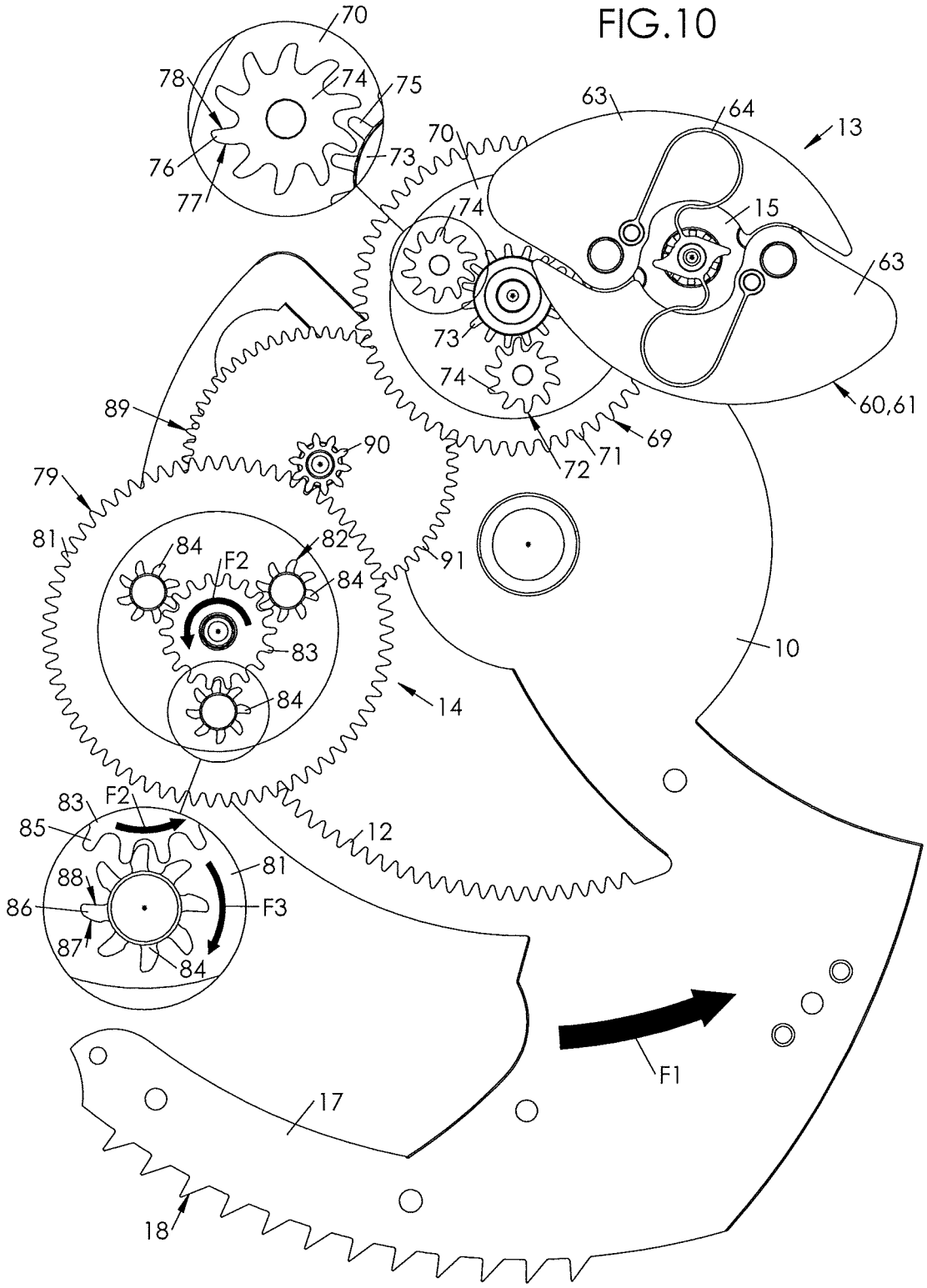

The rotation movement of the hours piece 10 during actuation of the repeater 5 is illustrated in FIG. 9 (in which the hours piece is locally cut away in line with the reversing gear 93, for greater clarity) and in FIG. 10 by the arrow F1 that indicates its direction.

The rotation of the hours piece 10, via the toothed ring 12 which meshes with the secondary input gear 80, drives rotation of the latter, with the secondary sun wheel 83 to which it is fastened (arrow F2, FIG. 9 and FIG. 10).

Under these conditions, and given the direction of mounting the secondary planet gears 84, the teeth 85 of the secondary sun wheel 83 drive the teeth 86 of the secondary planet gears on the side of its anterior flank 87 on which the teeth 85 slide, thus driving in freewheeling rotation the secondary planet gears (arrow F3, detail inset at the bottom in FIG. 10) without driving the secondary output wheel 81. The secondary mobile 79 is then in its disengaged configuration, so that the rotation of the hours piece 10 is not transmitted to the rotor 15 which, like the secondary output wheel 81, the middle mobile 89 and the primary mobile 69, remains immobile.

Figure 11:
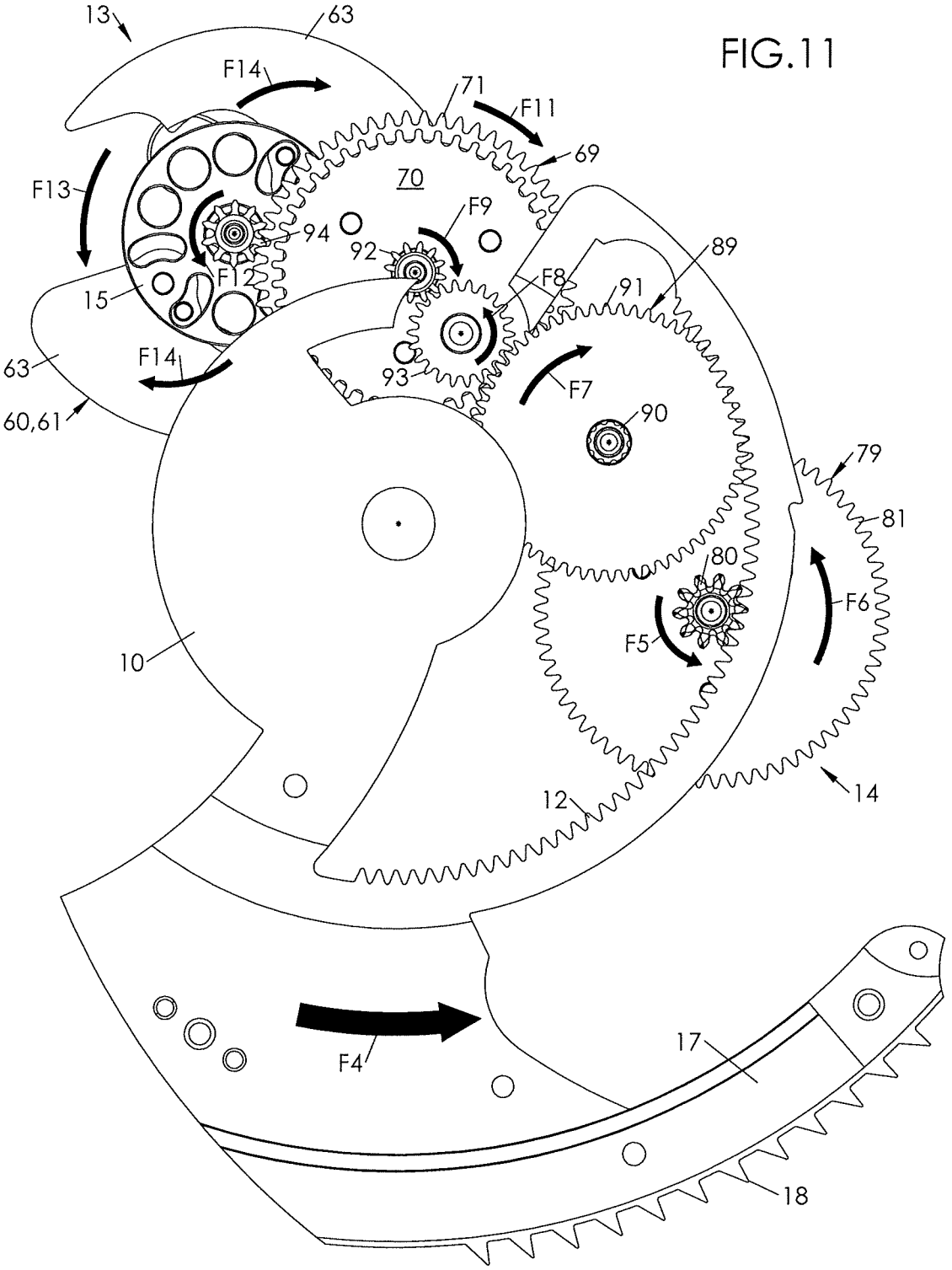
FIG. 11 and FIG. 12 are respectively views similar to FIG. 9 and FIG. 10, illustrating the opposite movement of the hours piece, and its return to its rest position.
Figure 12:
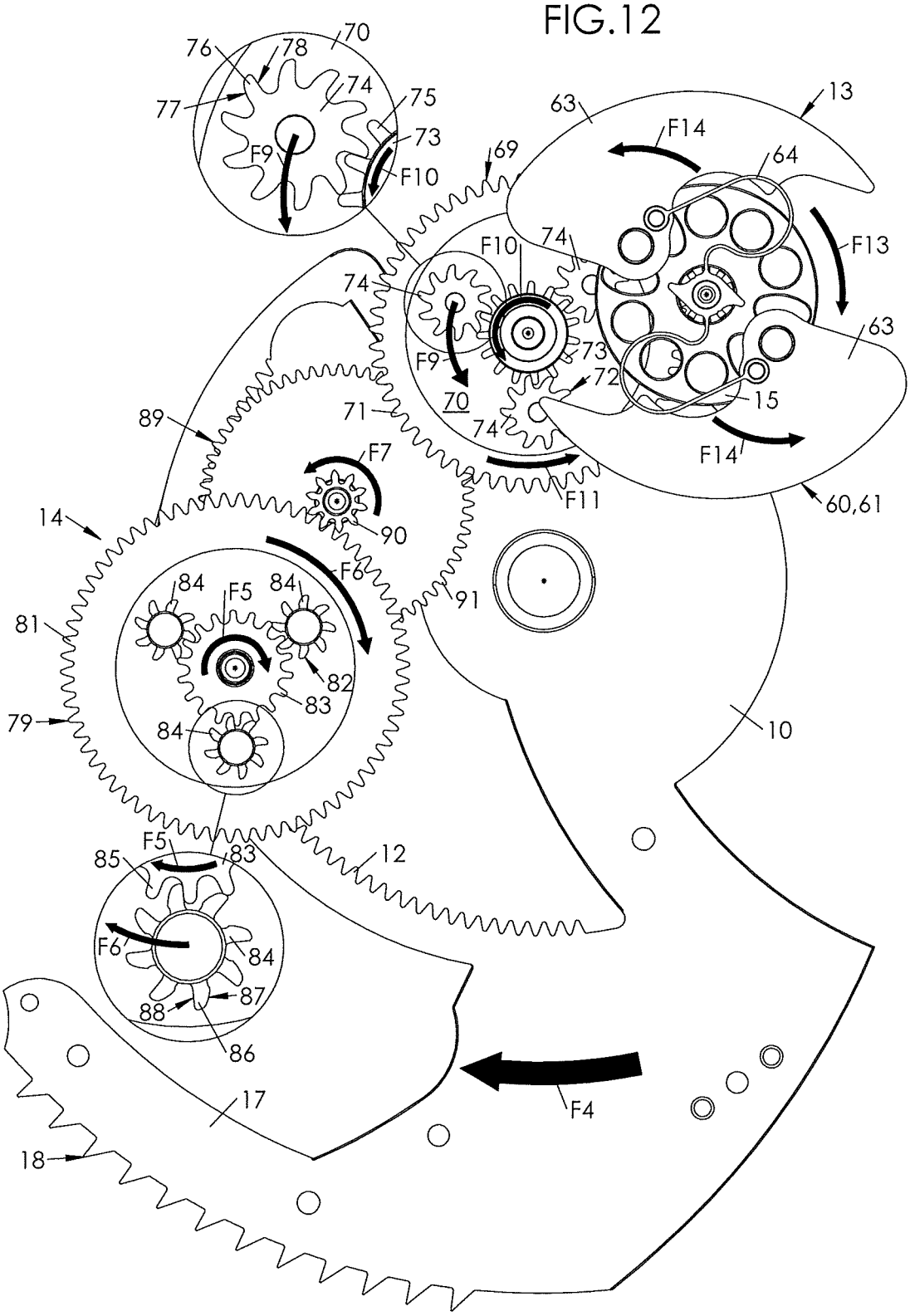

When the pusher member 59 is released, the barrel spring 35 retracts the pulley 38, which pulls on the chain 40, which carries the hours piece 10, which, starting from its reading position, finds itself driven in rotation about its axis A3 in the direction of its rest position (arrow F4, FIG. 11 and FIG. 12).

The rotation of the hours piece 10 drives, via the toothed ring 12 that meshes with the secondary input gear 80, the rotation of the latter, with the secondary sun wheel 83 that is fastened to it (arrow F5, FIG. 11 and FIG. 12).

Under these conditions, and given the mounting direction of the secondary planet gears 84, the teeth 85 of the secondary sun wheel 83 drive the teeth 86 of the secondary planet gears 84 on the side of its posterior flank 88, which braces the teeth 86, causes immobilization of the secondary planet gears on the secondary sun wheel and constraining to rotate therewith of the secondary output wheel 81 (on which are mounted the secondary planet gears 84), as illustrated in FIG. 11 and FIG. 12 by the arrows F6. The secondary mobile 79 is then in its engaged configuration, so that it transmits the rotation of the hours piece 10 to the middle mobile 89 (arrow F7, FIG. 11 and FIG. 12), which transmits it, via the reversing gear 93 (arrow F8, FIG. 11) to the primary gear 92 of the primary mobile 69, and therefore to the primary input wheel 70 that is fastened to it (arrow F9, FIG. 11 and FIG. 12).

Given the mounting direction of the primary planet gears 74, their teeth 76 drive the teeth 75 of the primary sun wheel 73 on the side of the posterior flank 78, which braces the teeth 76 and causes the immobilization of the primary planet gears on the primary sun wheel, which is therefore driven in rotation in the same direction (arrows F10, FIG. 12). As the primary sun wheel is itself fastened to the primary output wheel 71, the latter is consequently driven in rotation in turn in the same direction (arrow F11, FIG. 11 and FIG. 12).

The primary output wheel 71 meshes with the rotor gear 94, which is driven in rotation in the reverse direction (arrow F12, FIG. 11). The rotor 15, constrained to rotate with the rotor gear 94, is driven with it (arrow F13, FIG. 11 and FIG. 12).

With the following notation:

Z12 the number of teeth (referred to the entirety of its circumference) of the toothed sector 12 of the hours piece 10 (here, Z12=130), Z80 the number of teeth of the secondary input gear 80 (here, Z80=10)

Z81 the number of teeth of the secondary output wheel 81 (here, Z81=66), Z90 the number of teeth of the middle gear 90 (here, Z90=10), Z91 the number of teeth of the middle wheel 91 (here, Z91=60), Z92 the number of teeth of the primary gear 92 (here, Z92=12), Z71 the number of teeth of the primary output wheel 71 (here, Z71=55), Z94 the number of teeth of the rotor gear 94 (here, Z94=10), then the transmission ratio R between the hours piece 10 and the rotor 15 is:

$$R = \frac{Z12 \times Z81 \times Z91 \times Z71}{Z80 \times Z90 \times Z92 \times Z94}$$

For the number of teeth values given above, the transmission ratio R is therefore:

$$R = \frac{130 \times 66 \times 60 \times 55}{10 \times 10 \times 12 \times 10} = 2359.5$$

It is therefore seen that, for an estimated angular speed of the hours piece 10 of approximately 1 rpm, the rotor 15 would be driven, if it were not braked, at approximately 2360 rpm.

The rotor 15 is braked, however. In fact, the weights 63 are pivoted to their deployed position (arrow F14, FIG. 11 and FIG. 12) by the centrifugal force generated by the rotation of the rotor 15. The resulting increase of inertia, and the Laplace force generated by the Eddy currents induced by the rotation of the weights 15 in the alternating stationary electromagnetic field in the stator 16, are combined to brake the rotor 15, the angular speed of which plateaus at a so-called nominal angular speed, here of 2300 rpm.

As the primary mobile 69 and the secondary mobile 79 are both in their engaged position, the plateauing of the angular speed of the rotor 15 is communicated, via the transmission gear train 14, to the hours piece 10 the angular speed of which is therefore regulated during its movement from its reading position to its rest position.

The result of this is that the chiming of the current hour is produced at fixed frequency (or at least with a possible variation of frequency undetectable to the human ear).

When the hours piece 10 arrives at its rest position, it stops dead. As the toothed sector 12 meshes with the secondary input gear 80, the rotation of the latter is also stopped dead. The same applies to the secondary sun wheel 83 that is fastened to it.

However, the secondary output wheel 81 can continue to turn (arrow F6, FIG. 13 and FIG. 14), because the planet gears 84, driven with this wheel, then drive the secondary sun wheel 83 (stopped) on the side of the anterior flank 87 of their teeth 86. The planet gears are then driven in freewheeling rotation about their own axis (arrow F15, FIG. 14). The secondary mobile 79 is then in the disengaged configuration, and the secondary output wheel 81 freewheels.

Figure 13:
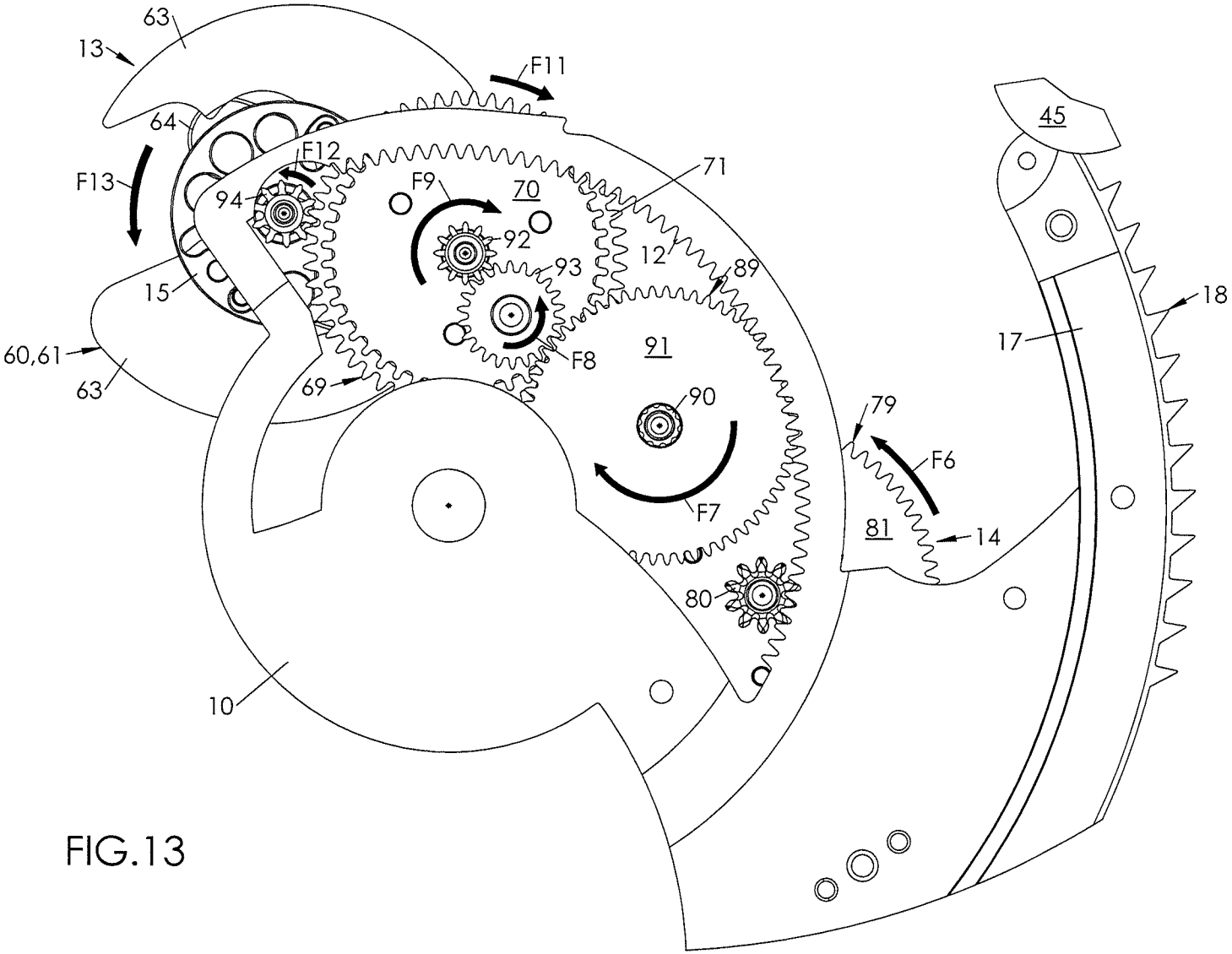
FIG. 13 and FIG. 14 are views similar, respectively, to FIG. 11 and to FIG. 12, illustrating the sudden stopping of the hours piece when returned to its rest position.
Figure 14:
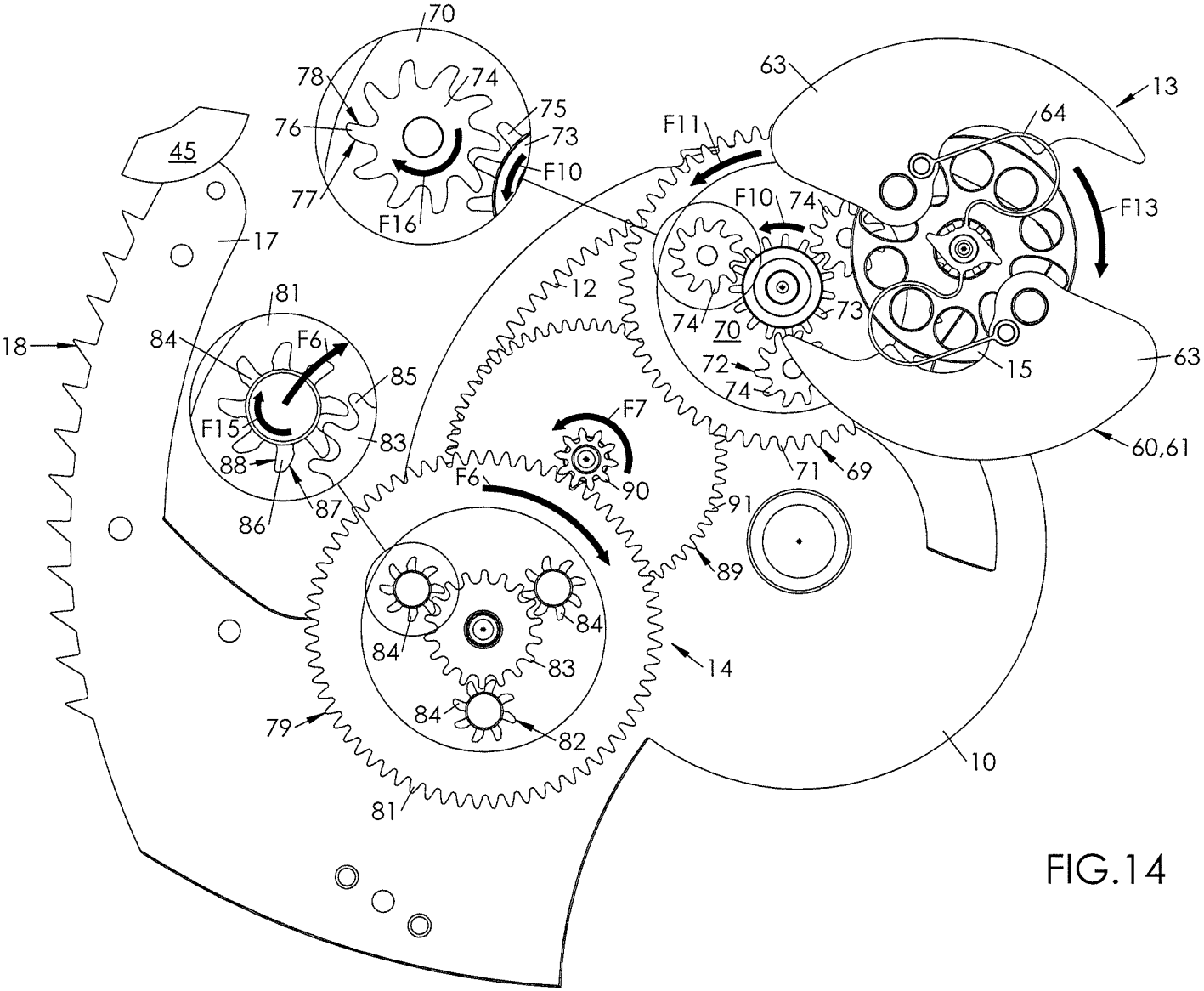

The middle wheel 91 (and with it the middle gear 90 that is fastened to it and meshes with the secondary output wheel 81) also continues its freewheeling rotation (arrow F7, FIG. 13 and FIG. 14). The rotation of the middle wheel 91 is transmitted to the primary gear 92 (arrow F9, FIG. 13) via the reversing gear 93 (arrow F8, FIG. 13).

The rotation of the secondary output wheel 81 and of the middle wheel 91 (meshing with the reversing gear 93 and the primary gear 92) decreases because of friction.

However, given the speed that it has attained and its inertia, the rotor 15 continues to turn (arrow F13, FIG. 13 and FIG. 14), and the reduction of its rotation speed is less than the reduction of the rotation speed of the middle wheel 91.

This is why the primary output wheel 71, which meshes with the rotor gear 94 (itself fastened to the rotor 15) turns faster (arrow F11, FIG. 13 and FIG. 14) than the primary input wheel 70, fastened to the primary gear 92 that meshes with the middle wheel 91 (via the reversing gear 93). In other words, the primary output wheel is driven in rotation relative to the primary input wheel. The result of this is that the primary sun wheel 73, constrained to rotate with the primary output wheel (arrow F10, FIG. 14), drives the primary planet gears 74 (mounted on the primary input wheel 70) on the side of the anterior flank 77 of their teeth 76 and therefore drives them in freewheeling rotation (arrow F16, detail inset at the top in FIG. 14), which enables the primary output wheel 71 and the primary input wheel 70 no longer to be constrained to rotate together, placing the primary mobile 69 in the disengaged configuration.

It follows from the foregoing that the hours piece 10 finds itself decoupled from the rotor 15, which is able (with the primary output wheel 71) to continue its freewheeling rotation despite the immobility of the hours piece.

Similarly, the secondary output wheel 81 (and with it the middle mobile 89 and the primary input wheel 70) is able to continue its freewheeling rotation despite the immobility of the hours piece 10.

This therefore avoids the hammer generated in the hours piece by it stopping dead at the end of travel, since, with the exception of the secondary input gear 80 (and the secondary sun wheel 83 that is fastened to it), all the other moving parts can continue their freewheeling rotation until they are stopped by friction.

The mechanical fatigue of the mobile components of the repeater 5 (and notably of the hours piece 10, the regulation device 13 and the transmission gear train 14) is considerably reduced by this.

The invention claimed is:

1. A repeater mechanism for a timepiece with a striking mechanism, which comprises:

an hours snail;

an hours piece provided with a toothed sector and carrying an hours follower, the hours piece being mounted to rotate between a fixed rest position, wherein the hours follower is angularly spaced from the hours snail, and a reading position wherein the hours follower comes into contact with the hours snail;

a device for regulating the angular speed of the hours piece, which comprises a rotor and a system for braking the rotor;

a transmission gear train between the hours piece and the rotor;

wherein the transmission gear train comprises a disengageable primary mobile able to adopt two configurations:

a) an engaged configuration wherein the primary mobile couples the hours piece and the rotor while the hours piece is moved from its reading position to its rest position;

b) a disengaged configuration wherein the primary mobile decouples the rotor and the hours piece as soon as the latter is stopped in the rest position, and wherein the primary mobile comprises:

a primary input wheel, mounted to rotate about a primary axis and connected to the hours piece;

a primary output wheel rotatable relative to the primary input wheel and connected to the rotor; and a unidirectional primary epicyclic gear train between the primary input wheel and the primary output wheel.

2. The mechanism according to claim 1, wherein the primary epicyclic gear train comprises a primary sun gear constrained to rotate with the primary output wheel, and one or more primary planet gears mounted on the primary input wheel and meshing with the primary sun wheel.

3. The mechanism according to claim 2, wherein the primary sun wheel has symmetrical teeth, and each primary planet gear has asymmetrical teeth.

4. The mechanism according to claim 2, wherein the primary epicyclic gear train comprises three primary planet gears.

5. The mechanism according to claim 1, wherein the transmission gear chain comprises a secondary mobile between the primary mobile and the hours piece, said secondary mobile comprising a secondary input gear mounted to rotate about a secondary axis and that meshes with the toothed sector of the hours piece, and a secondary output wheel connected to the primary mobile.

6. The mechanism according to claim 5, wherein the secondary mobile is disengageable.

7. The mechanism according to claim 6, wherein the secondary output wheel is rotatable relative to the secondary input gear, and the secondary mobile comprises a unidirectional secondary epicyclic gear train between the secondary input gear and the secondary output wheel.

8. The mechanism according to claim 7, wherein the secondary epicyclic gear train comprises a secondary sun gear constrained to rotate with the secondary input gear, and one or more secondary planet gears mounted to rotate on the secondary output wheel and meshing with the secondary sun wheel.

9. The mechanism according to claim 8, wherein the secondary sun wheel has symmetrical teeth, and each secondary planet gear has asymmetrical teeth.

10. The mechanism according to claim 9, wherein the secondary epicyclic gear train comprises three secondary planet gears.

11. The mechanism according to claim 5, wherein the transmission gear train comprises a middle mobile between the primary mobile and the secondary mobile.

12. The mechanism according to claim 11, wherein the middle mobile comprises a middle gear mounted to rotate about a middle axis, and a middle wheel constrained to rotate with the middle gear and meshing with the primary mobile.

13. The mechanism according to claim 12, wherein the primary mobile comprises a primary gear, fastened to the primary input wheel and meshing with the middle wheel.

14. A timepiece comprising the mechanism as claimed in claim 5.

15. The timepiece as claimed in claim 14, wherein the timepiece is a watch.

16. A timepiece comprising the mechanism as claimed in claim 1.

17. The timepiece as claimed in claim 16, wherein the timepiece is a watch.

18. A repeater mechanism for a timepiece with a striking mechanism, which comprises:

an hours snail;

an hours piece provided with a toothed sector and carrying an hours follower, the hours piece being mounted to rotate between a fixed rest position, wherein the hours follower is angularly spaced from the hours snail, and a reading position wherein the hours follower comes into contact with the hours snail;

a device for regulating the angular speed of the hours piece, which comprises a rotor and a system for braking the rotor;

a transmission gear train between the hours piece and the rotor;

wherein the transmission gear train comprises a disengageable primary mobile able to adopt two configurations:

a) an engaged configuration wherein the primary mobile couples the hours piece and the rotor while the hours piece is moved from its reading position to its rest position;

b) a disengaged configuration wherein the primary mobile decouples the rotor and the hours piece as soon as the latter is stopped in the rest position, and wherein the transmission gear chain comprises a secondary mobile between the primary mobile and the hours piece, said secondary mobile comprising a secondary input gear mounted to rotate about a secondary axis and that meshes with the toothed sector of the hours piece, and a secondary output wheel connected to the primary mobile.

19. The mechanism according to claim 18, wherein the secondary mobile is disengageable.

20. The mechanism according to claim 19, wherein the secondary output wheel is rotatable relative to the secondary input gear, and the secondary mobile comprises a unidirectional secondary epicyclic gear train between the secondary input gear and the secondary output wheel.

* * * * *